United States Patent [19]

Berkman et al.

[11] 4,099,041

[45] Jul. 4, 1978

[54] SUSCEPTOR FOR HEATING SEMICONDUCTOR SUBSTRATES

[75] Inventors: Samuel Berkman, Florham Park; Donald Bertram Irish, Somerville, both of N.J.

[73] Assignee: RCA Corporation, New York, N.Y.

[21] Appl. No.: 786,403

[22] Filed: Apr. 11, 1977

[51] Int. Cl.[2] ..... H05B 5/08

[52] U.S. Cl. ..... 219/10.49 R; 118/49.5

[58] Field of Search ..... 219/10.49, 10.57, 10.67; 13/1; 118/49.1, 49.5, 500, 620; 148/174, 175; 165/135; 427/45; 432/226, 265

[56] References Cited

U.S. PATENT DOCUMENTS

| | | | |
|---|---|---|---|
| 3,754,110 | 8/1973 | Van Dongen et al. | 118/49.5 |
| 3,845,738 | 11/1974 | Berkman et al. | 219/10.49 |
| 3,892,940 | 7/1975 | Bloem et al. | 219/10.49 |
| 3,980,854 | 9/1976 | Berkman et al. | 219/10.49 |

*Primary Examiner*—Bruce A. Reynolds

*Attorney, Agent, or Firm*—H. Christoffersen; T. H. Magee

[57] ABSTRACT

An integral graphite susceptor of the type comprising a hollow polyhedron, adapted to support a semiconductor substrate on an outer planar surface of a wall thereof, has a recessed cavity adjacent the inner surface of the wall and shaped so that the floor of the cavity is parallel to the outer planar surface. The cavity may comprise an oblong-shaped slot machined into the wall of the susceptor, which is typically a hollow truncated pyramid.

7 Claims, 4 Drawing Figures

SUSCEPTOR FOR HEATING SEMICONDUCTOR SUBSTRATES

The invention relates to a susceptor of the type comprising a hollow polyhedron adapted to support a substrate on an outer planar surface of a wall thereof.

In the production of certain semiconductor devices, an epitaxial layer of silicon on a substrate, such as a silicon wafer, is used as a starting material. The epitaxial layer of silicon is deposited upon the silicon wafer in a chemical vapor-deposition (CVD) process wherein the wafer is supported on a graphite susceptor and heated to a high temperature. A volatile compound of silicon is introduced and thermally decomposed, or reacted with other gases or vapors, at the surface of the wafer to yield silicon which deposits on the wafer surface.

Various types of susceptors have been utilized for supporting substrates during the chemical vapor-deposition process. In one type of apparatus, the substrates are placed on the upper side of a flat plate-shaped susceptor (slab) surrounded by an rf coil by which the susceptor is heated, as disclosed in U.S. Pat. 3,892,940, issued to Bloem et al. on July 1, 1975. In this type of susceptor, when the rf coil is energized, induced eddy currents will flow on the upper and lower sides of the susceptor, which currents are directed opposite to each other at the center of the slab. Bloem et. al. discloses the use of recesses in the lower side of such a susceptor in order to thereby decrease the heat generated by the rf field in the thinner regions adjacent the recesses. For effective slab heating, the thickness of the slab is usually a minimum of two $\delta$, where $\delta$ is the skin depth or depth of penetration equal to the depth below the surface where the current strength has a value $1/e$ times the current strength at the surface.

In another type of apparatus, the substrates are mounted on the sides of a susceptor having the shape of a hollow polyhedron, for example, a hollow truncated pyramid. Such a susceptor is typically made by starting with an integral pyramid-shaped piece of conventional graphite and then, starting at the base thereof, hollowing-out the inside into the shape of a cone. The susceptor is heated by circular rf induction coils which surround the graphite pyramid and induce a continuous circular current therein which flows in one direction only. Due to the fact that the outer surfaces upon which the substrates are mounted are planar and the inner surface is curved, the wall of such a susceptor has corner portions which are thicker than the central portions thereof. This variation in the thickness of the wall adjacent to the mounted substrates causes the substrate to heat unevenly, which results in the deposition of a non-uniform epitaxial layer upon the substrate.

In order to achieve uniform heating of the mounted substrates, truncated pyramid-shaped susceptors have been hollowed-out so that the wall thereof has outer and inner surfaces which are substantially similar and planar, as illustrated in U.S. Pat. No. 3,980,854, issued to Berkman et al. on Sept. 14, 1976 and assigned to RCA Corporation. However, due to the converging pyramid-shaped wall, it is extremely difficult and expensive to hollow-out such a structure, since the width of the wall continually changes as one "machines out" the graphite. Also, the corners of such a structure, due to their closer proximity to the surrounding rf coils heat at a faster rate than the central portions between the corners. This requires the continual use of cooling blowers in order to achieve acceptable epitaxial layers of uniform thickness.

Figure 1:
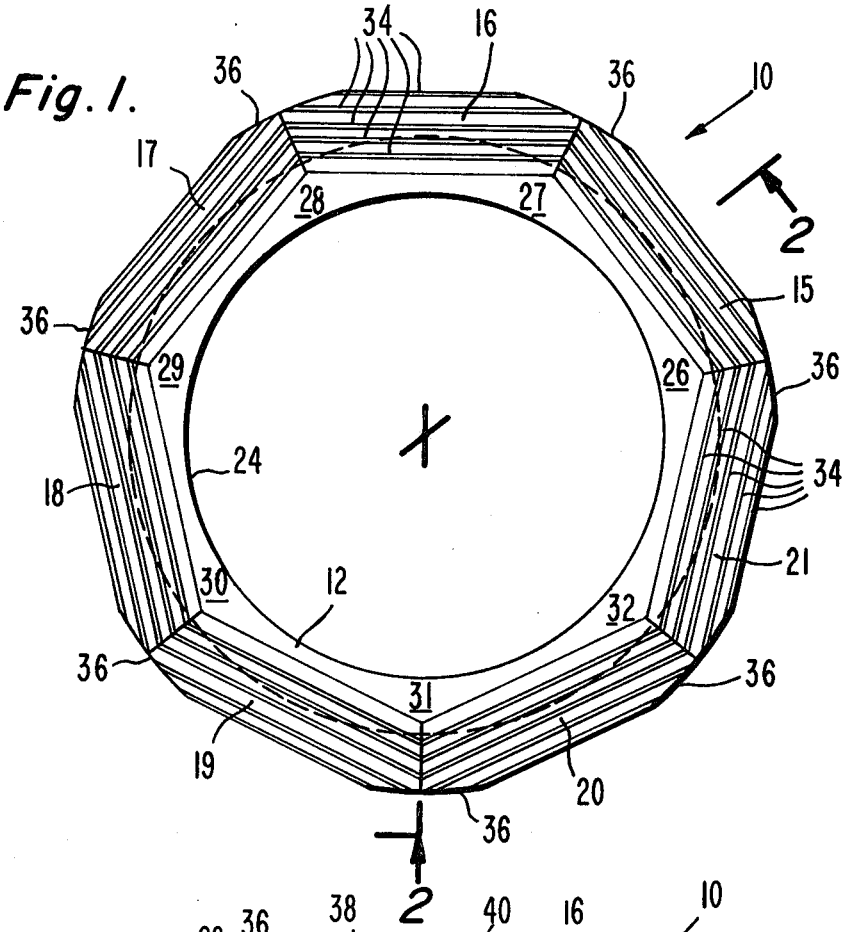
FIG. 1 is a plan view illustrating one embodiment of the present novel susceptor.
Figure 2:
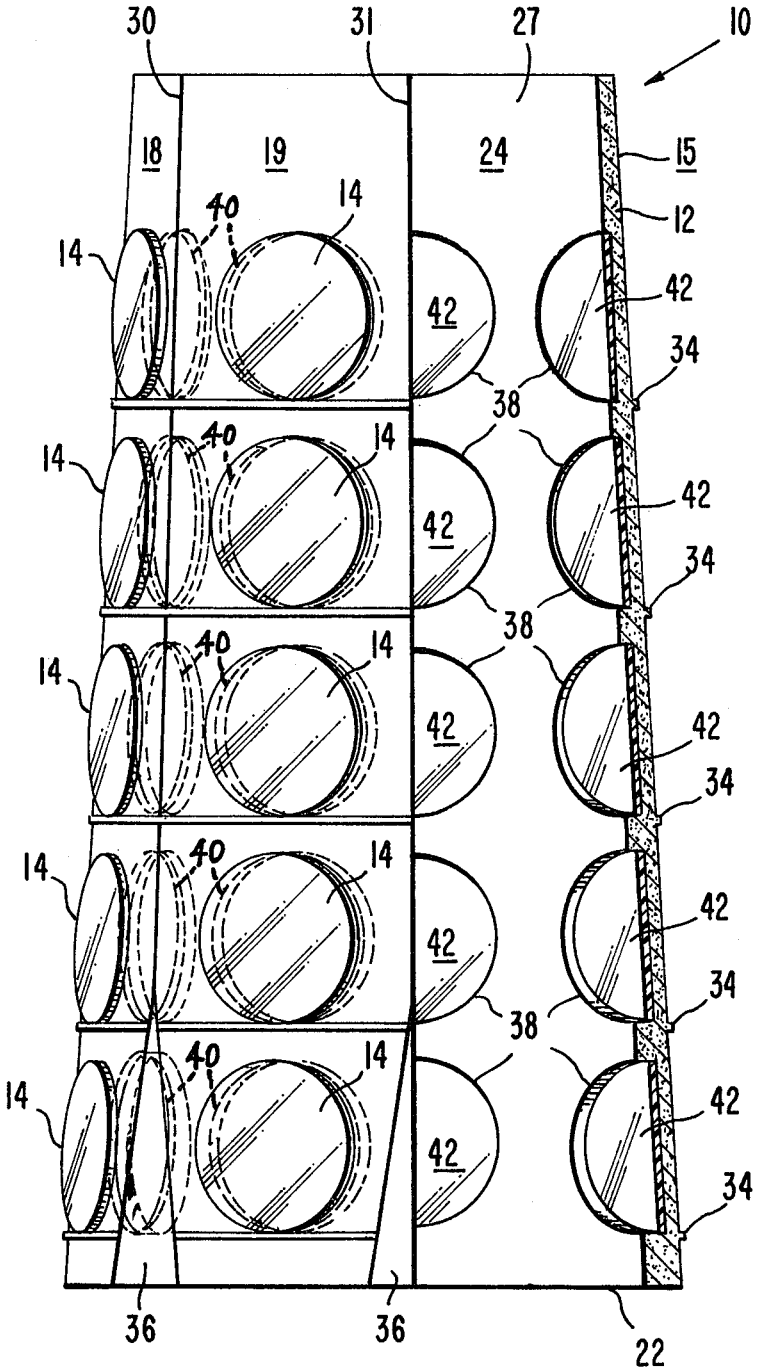
FIG. 2 is a partial, cross-sectional view taken along lines 2—2 of FIG. 1.

FIGS. 1 and 2 show a novel susceptor 10 having a wall 12 adapted to support semiconductor substrates 14 on a plurality of outer planar surfaces 15, 16, 17, 18, 19, 20 and 21 thereof, which form a hollow truncated pyramid. Although the structure of the susceptor 10 is shown as a heptagonal pyramid, it may take the shape of any hollowed-out polyhedron, adapted to suit the requirements of a particular manufacturing process.

The susceptor 10 preferably comprises an integral piece of conventional graphite which has been hollowed-out by a machine tool. The susceptor 10 shown in FIGS. 1 and 2 typically is made by starting with a pyramid-shaped piece of graphite and then, starting at the base 22 thereof, machining-out the inside wherein the inner surface 24 of the wall 12 has the shape of a cone. Due to the fact that the outer surfaces 15–21 upon which the substrates 14 are mounted are planar and the inner surface 24 is curved, the wall 12 of such a susceptor 10 has, where the planar surfaces 15–21 intercept, corner portions 26, 27, 28, 29, 30, 31 and 32 which are thicker than the central portions of the wall 12 disposed between the corner portions 26–32.

A plurality of ledges 34 extend outwardly from the outer surfaces 15–21 of the wall 12, as shown in FIGS. 1 and 2. The ledges 34 support the semiconductor substrates 14 against the outer surfaces 15–21 of the wall 12, as shown in FIG. 2. The upper and lower surfaces of the ledges 34 preferably extend substantially perpendicular from the planar surfaces 15–21 to an extent of about 0.6–0.7 millimeters. The thickness of the ledges 34 is about 1.2–1.5 millimeters.

The lower portions of the wall 12, near the bottom sections of the planar surfaces 15–21, are cut away to form a plurality of relatively small triangular surfaces 36 adjacent to the base 22 of the susceptor 10. Hence, a horizontal cross-section of the susceptor 10 near the base 22 is a polygon of 14 sides, and a horizontal cross-section near the top portion of the susceptor 10 is a polygon of 7 sides. This structure allows the susceptor 10 to be relatively large for a given sized vertical furnace, whereby to support and process a maximum number of substrates 14.

The susceptor 10 is adapted for use in a typical vertical reactor furnace heated by electrical induction energy (about 10 to 400 KHz) so that a material can be deposited onto the substrates 14 from reacting chemical components in a vapor-deposition process, well known in the art. The susceptor 10 is usually heated by circular rf induction coils (not shown) which surround the graphite susceptor 10 and induce a current therein. While the dimensions of the susceptor 10 described herein are not critical, the values given are for illustrative purposes. The wall 12 of the susceptor 10 at the corner portions 26–32 thereof is about 15–20 millimeters in thickness, and about 8–12 millimeters in thickness at the central portions at the wall 12. The height of the susceptor 10 is about 300–350 millimeters, and the ledges protrude just enough so as to maintain the substrates 14 in place without substantially interfering with the sensitive gas flow dynamics of reacting gases within the furnace. It has been found that best results are obtained where there is a minimum of interference with the gas flow dynamics of the reacting chemical components within the furnace. This is accomplished when each of the planar surfaces 15–21 makes about a 3° angle with the vertical. With such a structure the susceptor 10 can support a maximum number of substrates 14 in an efficient chemical vapor-deposition process.

The susceptor 10 further comprises a plurality of recessed cavities 38 adjacent to the inner surface 24 of the susceptor 10. The structure of each cavity 38 is such that the floor 40 thereof is parallel to the outer planar surface adjacent thereto. In the embodiment shown in FIG. 2, each cavity 38 comprises a circular recess machined into the wall 12 through the inner surface 24 thereof. The diameter of each parallel surface 40 is approximately equal to the diameter of the substrates 14 supported by the susceptor 10, and the thickness of the wall 12 at the parallel surfaces 40 is about 8–12 millimeters.

Figure 3:
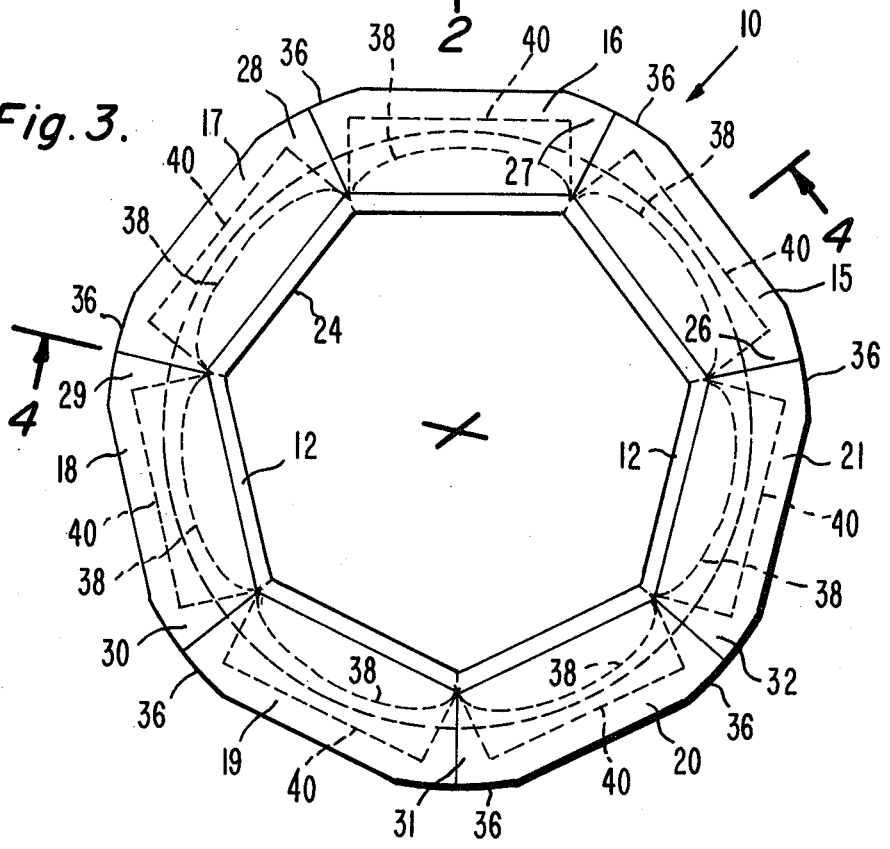
FIG. 3 is a plan view illustrating a second embodiment of the present novel susceptor.
Figure 4:
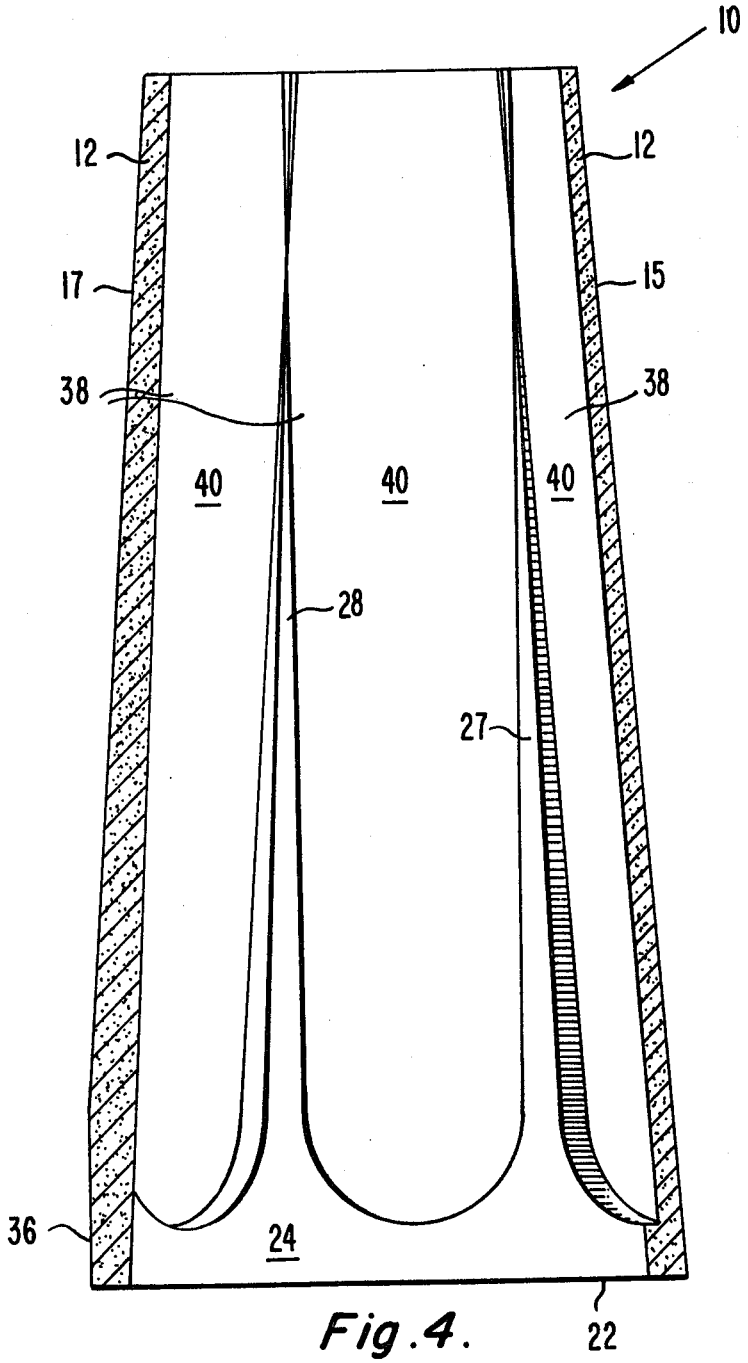
FIG. 4 is a partial, cross-sectional view taken along line 4—4 of FIG. 3.

Also shown in FIG. 2 are pyrolytic graphite heat shields 42 which are inserted into the cavities 38. The heat shields 42 have a lower heat conductivity than that of the wall 12 along a direction transverse to the wall 12. Such heat shields 42 enhance the desirable heating effect gained by utilizing the recessed cavities 38. For more detailed information on use of pyrolytic heat shields, see U.S. Pat. No. 3,980,854 issued to Berkman et al. on Sept. 14, 1976 and assigned to RCA Corporation Referring to FIGS. 3 and 4 of the drawings, there is shown a second embodiment of the present novel susceptor 10. In this susceptor 10 the recessed cavities 38 comprise oblong-shaped slots which are machined into the wall 12 through the inner surface 24. The slots have a constant width which is approximately equal to the diameter of the substrates 14 supported by the susceptor. The thickness of the wall 12 at the parallel surfaces 40 is about 8–12 millimeters. As shown in FIGS. 3 and 4, such slots are machined straight up through the top of the susceptor 10 where the parallel surfaces 40 intersect and slightly overlap each other. Although not shown in this embodiment, pyrolitic graphite may also be inserted in the oblong-shaped slots.

The structure of the novel susceptor 10 allows for the deposition of more uniform epitaxial layers upon the semiconductor substrates 14. Since the wall 12 of the susceptor 10 adjacent to the planar surfaces 40 is of a constant thickness which extends over most of the diameter of the supported substrates 14, the heating of the substrates 14, by means of an rf induction coil, is much more uniform and thereby allows for more uniform deposition of material across the surfaces of the substrates 14. The use of recessed cavities 38 also allows the corner portions 26–32, where the planar surfaces 15–21 intersect, to remain thicker than the central portions of the wall 12 adjacent to the supported substrates 14. Consequently, such corner portions 26–32 remain cooler than if the entire wall 12 was of constant thickness, and the use of cooling air as described above may be minimized with subsequent savings in power consumption. Such a heating effect is in direct contrast with that obtained from recesses disposed in a flat plate-shaped susceptor wherein the thinner portions become cooler than the thicker portions, due to the opposing eddy currents. The present invention is particularly significant when the "hollow-cylinder" type of susceptor is operated at relatively low frequencies of the order of 10 KHz, due to the fact that, when the average wall thickness is less than one $\delta$, variations in wall thickness at low frequencies have a much more pronounced effect on the uniformity of heating across the surfaces of the supported substrates. In addition, such a novel susceptor 10 is easier and cheaper to manufacture than one where the walls are of constant thickness, because the thickness of the recessed cavities 38 remain constant, making the machining-out process much easier.

What is claimed is:

1. In a susceptor of the type comprising a hollow polyhedron adapted to support a substrate on an outer planar surface of a wall thereof, said wall having corner portions thereof thicker than the central portions thereof, the improvement comprising said wall having a recessed cavity adjacent the inner surface thereof, said cavity having the floor thereof parallel to said outer planar surface.

2. A susceptor as defined in claim 1 wherein said susceptor is a truncated pyramid.

3. A susceptor as defined in claim 2 wherein said cavity comprises an oblong-shaped slot machined into said wall.

4. A susceptor as defined in claim 2 wherein said cavity comprises a circular recess machined into said wall.

5. A susceptor as defined in claim 1 wherein the width of said planar surface is approximately equal to the diameter of the substrate to be supported by said susceptor.

6. A susceptor as defined in claim 1 wherein said susceptor comprises an integral piece of conventional graphite.

7. A susceptor as defined in claim 6 wherein a heat shield of pyrolytic graphite is disposed within said cavity, said heat shield having a lower heat conductivity than that of said wall along a direction transverse to said wall.

* * * * *